US005778631A

United States Patent [19]

Simmons

[11] Patent Number: 5,778,631

[45] Date of Patent: Jul. 14, 1998

[54] AUTOMATED CUSHIONING PRODUCING AND DISPENING SYSTEM

[75] Inventor: James A. Simmons, Painesville Township, Ohio

[73] Assignee: Ranpak Corp., Concord Township, Ohio

[21] Appl. No.: 797,103

[22] Filed: Feb. 7, 1997

[51] Int. Cl.[6] ..... B31F 1/10; B65B 55/20; B65B 57/00

[52] U.S. Cl. ..... 53/55; 53/139.5; 53/472; 53/493; 53/505; 493/24; 493/352; 493/464; 493/967

[58] Field of Search ..... 53/55, 493, 505, 53/64, 66, 69, 67, 520, 115, 117, 530, 139.5, 472; 493/967, 24, 352, 354, 464, 381, 346

[56] References Cited

U.S. PATENT DOCUMENTS

| | | | |
|---|---|---|---|
| 3,251,452 | 5/1966 | Conway et al. . | |
| 3,509,797 | 5/1970 | Johnson | 53/472 X |
| 3,621,981 | 11/1971 | Nimmo, Jr. et al. . | |
| 3,820,648 | 6/1974 | Halvorsen . | |
| 3,899,166 | 8/1975 | Behn . | |
| 4,008,796 | 2/1977 | Aylon | 198/460 |
| 4,026,198 | 5/1977 | Ottaviano | 493/967 X |
| 4,073,375 | 2/1978 | Hart et al. | 198/466 |
| 4,085,662 | 4/1978 | Ottaviano | 493/967 X |
| 4,109,040 | 8/1978 | Ottaviano | 493/967 X |
| 4,385,537 | 5/1983 | Wolf | 83/100 |
| 4,557,716 | 12/1985 | Ottaviano | 493/464 |
| 4,619,635 | 10/1986 | Ottaviano | 493/36 |
| 4,650,456 | 3/1987 | Armington | 493/464 |
| 4,717,613 | 1/1988 | Ottaviano | 428/129 |
| 4,746,255 | 5/1988 | Roccabianca et al. | 414/84 |
| 4,750,896 | 6/1988 | Komaransky et al. | 493/357 |
| 4,968,291 | 11/1990 | Baldacci et al. | 493/354 |
| 5,403,259 | 4/1995 | Parker | 493/352 |
| 5,468,208 | 11/1995 | Armington et al. | 493/352 |
| 5,469,208 | 11/1995 | Dea | 348/27 |

FOREIGN PATENT DOCUMENTS 9513914 5/1995 WIPO .

*Primary Examiner*—James F. Coan
*Attorney, Agent, or Firm*—Renner, Otto, Boisselle & Sklar, P.L.L.

[57] ABSTRACT

A redundant automated cushioning producing and dispensing system includes a plurality of spaced cushioning conversion machines which convert stock paper into pads of a selected length, each cushioning conversion machine including a controller for controlling operation of the machine and communicating with another machine, a pad dispenser, and a sensor for determining when the amount of stock paper is less than a predetermined amount, a conveyor extending between the plurality of cushioning conversion machines for conveying a container into which a pad is to be dispensed, and at least one container sensor for providing information to at least one controller from which the controller can determine whether a pad has been dispensed into a container whereby the controllers cooperate to selectively switch operation of the cushioning conversion machine from an active state to an inactive state in accordance with information received from the stock supply sensors.

7 Claims, 4 Drawing Sheets

AUTOMATED CUSHIONING PRODUCING AND DISPENING SYSTEM

FIELD OF THE INVENTION

This invention relates generally to an automated redundant cushioning system which continuously provides cushioning product to containers.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alternative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4,026,198; 4,085,662; 4,109,040; 4,237,776; 4,557,716; 4,650,456; 4,717,613; 4,750,896; and 4,968,291. (These patents are all assigned to the assignee of the present invention and their entire disclosures are hereby incorporated by reference.) Such a cushioning conversion machine converts sheet-like stock material, such as paper in multi-ply form, into low density cushioning pads or dunnage.

A cushioning conversion machine, such as those disclosed in the above-identified patents, may include a stock supply assembly, a forming assembly, a gear assembly, and a cutting assembly, all of which are mounted on the machine's frame. During operation of such a cushioning conversion machine, the stock supply assembly supplies the stock material to the forming assembly. The forming assembly causes inward rolling of the lateral edges of the sheet-like stock material to form a continuous strip having lateral pillow-like portions and a thin central band. The gear assembly, powered by a feed motor, pulls the stock material through the machine and also coins the central band of the continuous strip to form a coined strip. The coined strip travels downstream to the severing or cutting assembly which severs or cuts the coined strip into pads of a desired length.

It is often advantageous to be able to supply a pad to containers or totes in an assembly line fashion. In such an instance it is undesirable for there to be an interruption in the pad formation process as may occur when the cushioning conversion machine runs out of stock material or must be serviced. It would be desirable to provide a cushioning conversion system with minimal down time.

SUMMARY OF THE INVENTION

The present invention provides an automated cushioning conversion system including redundant cushioning conversion machines operable to form pads and dispense them into containers and a control system for controlling which cushioning conversion machine is active.

In accordance with one aspect of the invention a redundant automated cushioning producing and dispensing system includes a plurality of spaced cushioning conversion machines which convert stock paper into pads of a selected length, each cushioning conversion machine including a controller for controlling operation of the machine and communicating with another machine, a pad dispenser, and a sensor for determining when the amount of stock paper is less than a predetermined amount, a conveyor extending between the plurality of cushioning conversion machines for conveying a container into which a pad is to be dispensed, and at least one container sensor for providing information to at least one controller from which the controller can determine whether a pad has been dispensed into a container whereby the controllers cooperate to selectively switch operation of the cushioning conversion machine from an active state to an inactive state in accordance with information received from the stock supply sensors.

In general, the invention comprises the foregoing and other features hereinafter fully described and particularly pointed out in the claims, the following description and the annexed drawings setting forth in detail a certain illustrated embodiment of the invention, this being indicative, however, of but one of the various ways in which the principles of the invention may be employed.

DETAILED DESCRIPTION OF THE INVENTION

Figure 1:
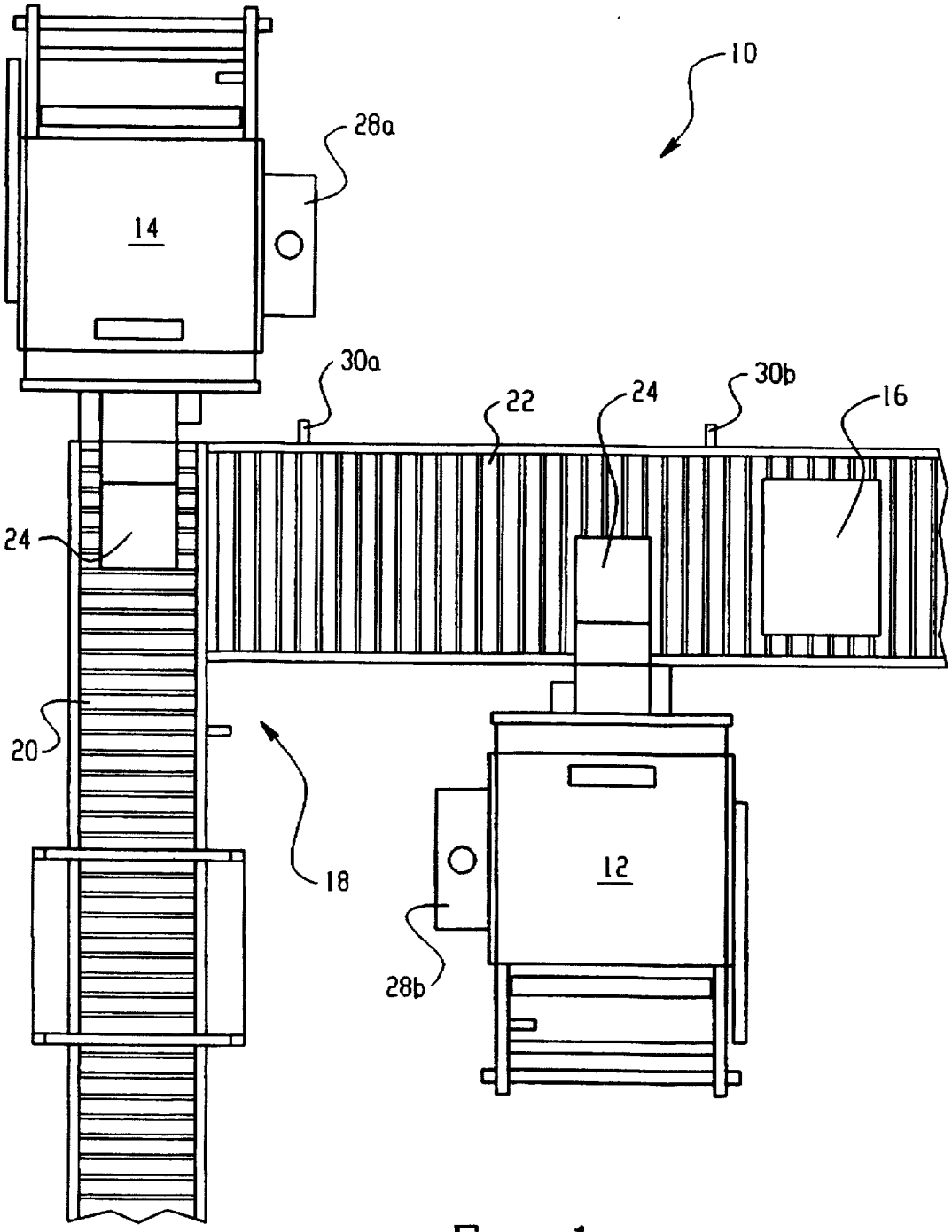
FIG. 1 is a plan view of the redundant automatic cushioning system of the present invention employing two cushioning conversion machines.
Figure 2:
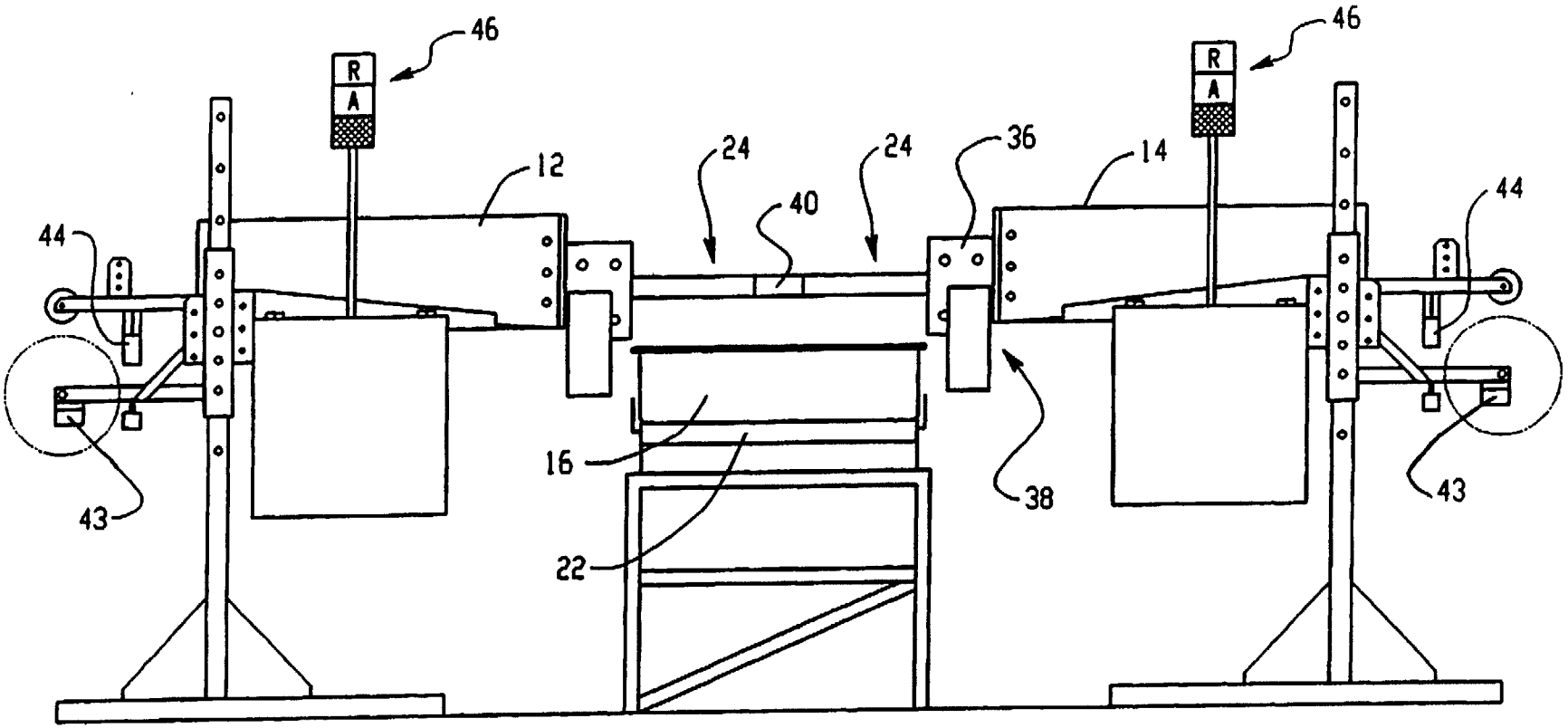
FIG. 2 is a elevational view of the automatic cushioning system of FIG. 1.
Figure 3:
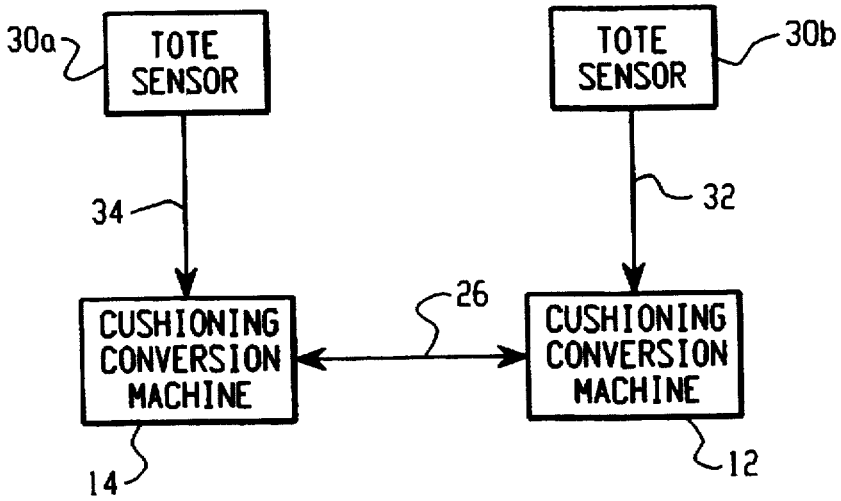
FIG. 3 is a schematic illustration of the communication and control between various components of the cushioning conversion system.

With reference to the drawing and initially to FIGS. 1 through 3, there is shown an automated cushioning conversion system 10 including a pair of redundant cushioning conversion machines 12 and 14 operable to produce and dispense a pad of a predetermined length into a container or tote 16 moving along a conveyor system 18. In the embodiment disclosed in FIG. 1, the conveyor system 18 includes two perpendicularly oriented powered roller conveyors 20 and 22. Although other arrangements of a conveyor system including a linear system and other types of conveyors may be used. Each cushioning conversion machine 12, 14 is positioned relative to the conveyor system 18 and includes a pad dispenser 24 allowing a formed pad to be dispensed into a tote 16 traveling along the conveyor. The cushioning conversion machines 12 and 14 communicate with each other as shown schematically in FIG. 3 along the signal line 26 to convey information to each other regarding whether the machine is low on paper or has suffered a jam, for example. Each cushioning conversion machine 12, 14 may include a redundancy controller 28 for integrating the cooperative operation of the cushioning conversion machines or the functionality of the redundancy controllers 28 may be incorporated into an internal machine controller, as discussed below.

The totes 16 may be a container from which one or more items will be removed along with a pad for packaging into a box or separate container for shipping. The system 10, however, has equal applicability to filling the actual box or container to be shipped. Thus, herein all references to a tote also includes other types of containers or boxes including reusable containers for temporary storage as well as an actual shipping box or container.

One or more tote sensors 30 are also provided adjacent the conveyor assembly 18 to sense the presence of a tote 16 at that point along the conveyor. For example, a sensor 30*a* may be oriented immediately upstream of the cushioning conversion machine 14 and a like sensor 30*b* may be located immediately upstream of the cushioning conversion machine 12.

In operation, generally one of the cushioning conversion machines 12, 14 is active producing and dispensing pads while the other is inactive waiting to take over for the other cushioning conversion machine when the active machine runs out or low of supply stock. For brief periods of time, especially when responsibility for dispensing pad is switching from the downstream cushioning conversion machine 14 to the upstream cushioning conversion machine 12, both machines may be active.

As an example consider the case where the upstream cushioning conversion machine 12 is active and the downstream cushioning conversion machine is inactive. As a tote 16 is conveyed toward the left in FIG. 1 by the conveyor 22, the tote 16 will cross the sensor 30*b* which will inform the cushioning conversion machine 12 over signal line 32 that a tote is available for filling with a pad. The cushioning conversion machine 12 will then dispense a pad from the pad dispenser 24 into the tote 16 and the tote will continue along the conveyor system 18. As the cushioning conversion machine 14 is in an inactive mode, the cushioning conversion 14 will not provide an additional pad to the tote 16. Preferably the tote sensor 30*a* will, however, sense the tote and provide that information to the redundancy controller 28*a* over signal line 34 for recording. As the tote 16 further progresses down the conveyor 22 it will be deposited onto the conveyor 20 and continue to travel along conveyor 20. The cushioning conversion machine 12 will continue to produce pads and dispense a pad into each tote 16 that passes thereby until the supply of stock material to convert into a pad runs out or is less than a predetermined amount.

When the cushioning conversion machine 12 senses that it is low or out of paper, or has suffered a jam, the redundancy controller 28*b* of the cushioning conversion machine 12 will inform the redundancy controller 28*a* of the cushioning conversion machine 14 over the signal line 26 to assume responsibility for dispensing pads into the totes and the downstream cushioning conversion machine will become active while the upstream cushioning conversion machine will switch to an inactive mode. Since there may be a number of totes situated on the conveyor 22 between the cushioning conversion machines 12 and 14 which already contain a pad, preferably the cushioning conversion machines maintain a count of the number of totes which have been detected by their respective sensors 30*b* and 30*a*. The totes 16 are thus effectively electronically "tagged" with a number and thus the redundancy controller 28*b* of the cushioning conversion machine 12 can inform the redundancy controller 28*a* of the cushioning conversion machine 14 the count or number of the first tote into which a pad has not been deposited by the cushioning conversion machine 12. Once the first empty tote 16 has been sensed by the cushioning conversion machine 14, the cushioning conversion machine 14 will deposit a pad in that tote and each subsequent tote until it becomes low on paper.

When the downstream cushioning conversion machine 14 senses that it is low on stock paper, the redundancy controller 28*a* will inform the redundancy controller 28*b* of the upstream cushioning conversion machine 12 to activate the cushioning conversion machine 12 to start depositing pads in the next tote to be detected by the sensor 30*b*. Since it is possible that there may be a number of totes 16 located between the cushioning conversion machines 12 and 14 that have not had pads dispensed therein, it is desirable that the cushioning conversion machine 14 detect its low paper condition with a sufficient reserve of paper to produce pads to fill each of the totes possibly located between the cushioning conversion machines and that the cushioning conversion machine 14 remain active long enough to dispense pads into those totes. The cushioning conversion machines 12 and 14 will again preferably communicate information on the counted number of the first tote into which a pad has been dispensed by the cushioning conversion machine 12 so that the cushioning conversion machine 14 can cease operation at the appropriate time without missing dispensing a pad in a tote or dispensing a second pad in a tote.

The cushioning conversion machines 12 and 14 as well as the tote sensors 30*a* and 30*b* can be arranged differently to accomplish the same results, as will be apparent to one skilled in the art. For example, the sensor 30*a* may be a sensor adapted to sense whether a tote 16 passing thereby includes a pad or not. In which case, the cushioning conversion machine 14 would automatically dispense a pad into any tote 16 which the sensor 30*a* has determined does not include a pad. In such an embodiment it may not be necessary to keep track of or count totes as they pass the tote sensors 30*a* and 30*b*.

The pad dispenser 24 preferably includes a pad conveyor apparatus 36 for receiving pads from the output area 38 of a cushioning conversion machine and gripping the pad such as through pairs of opposed drive rollers and pulling the pad from the machine along a dispensing plate 40. The dispensing plate 40 preferably includes a number of vacuum ports which, when a vacuum is applied, are operable to retain a pad against the dispenser plate 40. One or more jets of air may also be directed from below the pad such as from the housing 42 to further aid in holding the pad against the dispenser plate 40. When a tote 16 has been determined, such as through the sensors 30*a* or 30*b*, to be directly below the dispensing plate 40, the vacuum supplied to the dispenser plate 30 is terminated as is the air directed onto the pad from the housing 42, and the pad will drop by the force of gravity into the tote 16 therebelow.

Each cushioning conversion machine, as discussed above, preferably includes a stock supply sensors 43 for determining a low level of stock material as well as the end of the stock material on the stock supply roll 44. The stock supply sensors 43 communicate with the redundancy controller 28 of an associated cushioning conversion machine so that the redundancy controllers 28*a* and 28*b* can accomplish switching the pad dispensing tasks between the cushioning conversion machines. Each cushioning conversion machine is also preferably provided with an indicator lamp 46 which provides a visual indication to an operator when a machine needs to have its roll of supply stock material replaced.

Through the coordinated control of the cushioning conversion machines 12 and 14 as accomplished by the redundancy controllers 28*a* and 28*b* and the sensors 30*a*, 30*b*, a redundant cushioning conversion system is accomplished for continuously supplying pads to totes without an interruption in the production of pads.

Figure 4:
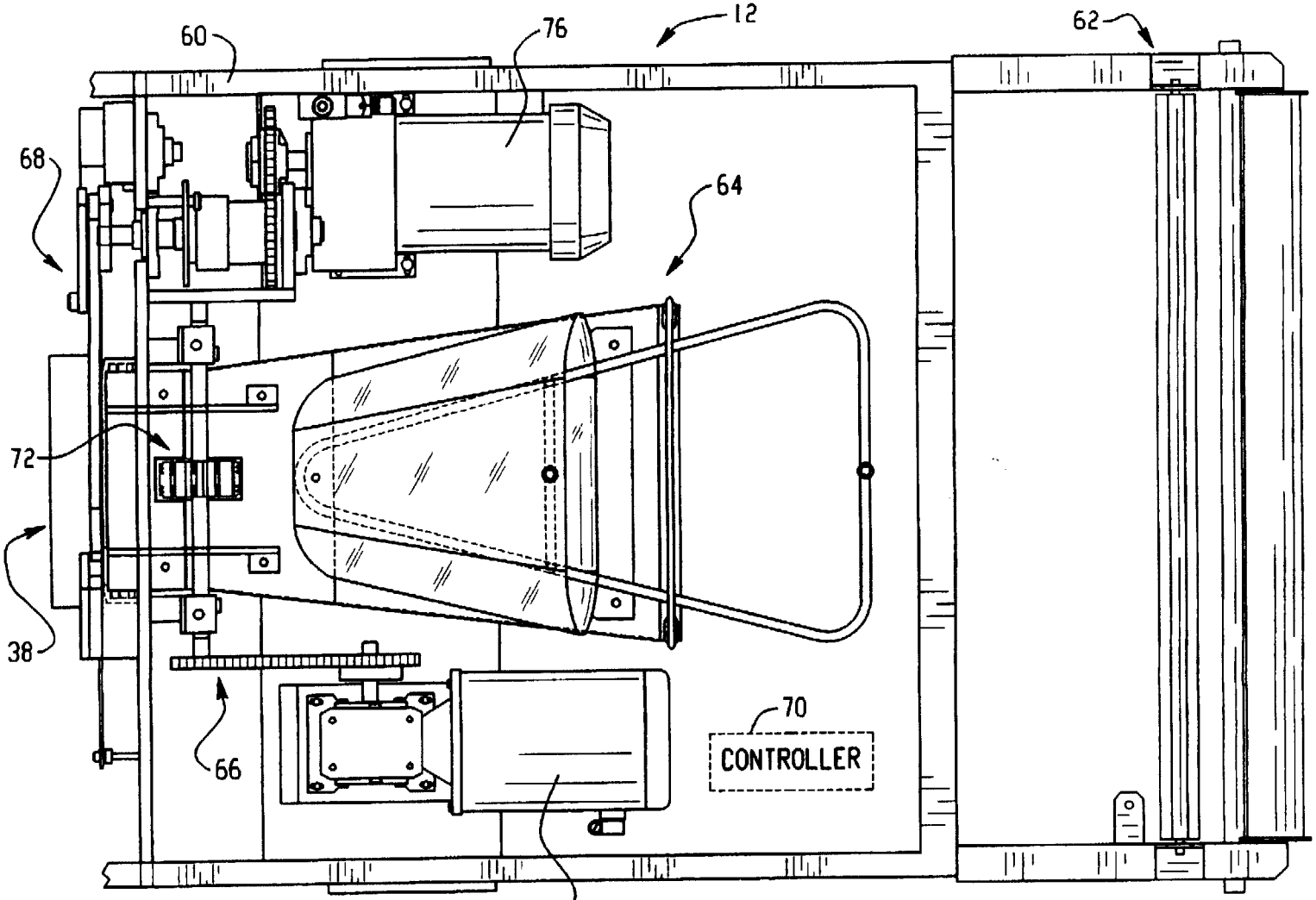
FIG. 4 is partial top view of one of the cushioning conversion machines.

Turning then to a more detailed discussion of the individual components of a cushioning conversion machine and with reference to FIG. 4, a cushioning conversion machine such as the cushioning conversion machine 12 includes a frame 60 by which are supported the various components for converting stock material, such as kraft paper, to a strip of cushioning product and severing the strip into pads of the desired length. Such components include a stock supply assembly 62, a forming assembly 64 for forming the stock material into the strip of cushioning product, a feed assembly 66 for feeding stock material through the forming assembly and a cutting assembly 68 which severs the strip of cushioning product into pads of a desired length. These components and their functioning are described more fully in U.S. patent application Ser. No. 08/188,305, which is incorporated herein through this reference. The operation of the feed assembly 66 and the cutting assembly 68 which cooperate to produce a pad of the desired length are controlled by a machine controller (shown schematically at 70), such as the machine controller described in co-owned U.S. patent application Ser. Nos. 08/279,149 and 08/482,015 which are incorporated herein by this reference. In some instances the functions of the redundancy controller 28 and the machine controller 70 may be implemented through a single processor, or further divided for implementation by additional processing elements or controllers.

During the conversion process, the feed assembly 66 draws the continuous strip of stock material from the stock supply assembly 62 and through the forming assembly 64 by the action of two cooperating and opposed gears 72 which are rotated through power supplied by the feed motor 74. As the strip of stock material is drawn through the forming assembly 64, the forming assembly causes the lateral edges of the stock material to roll inwardly to form a continuous strip having two lateral pillow-like portions and a central band therebetween. The opposed gears 72 of the feed assembly 66 additionally perform a "coining" or "connecting" function as the gears coin the central band of the continuous strip as it passes through the nip of the gears to form a coined strip. As the coined strip travels downstream from the feed assembly 66, the cutting assembly 68, powered by the cut motor 76, severs the strip into sections or pads of a desired length. A cut pad is conveyed from the machine exit 38 by the pad conveyor 36 to the pad dispenser plate 40 where it waits to be dispensed into a tote. Once a pad has been dispensed, the machine controller 70, provided the machine is still in an active state as informed by the associated redundancy controller 28, will instruct the machine to produce another pad.

While an automated cushioning system has been described relative to a number of specific embodiments, it will be readily apparent that the present invention has a wide range of applications to many different types and embodiments of cushioning conversion machines and conveyors.

What is claimed is:

1. A redundant automated cushioning producing and dispensing system, comprising:

a plurality of spaced cushioning conversion machines which convert stock paper into pads of a selected length, each cushioning conversion machine including a controller for controlling operation of the machine and communicating with another machine, a pad dispenser, and a sensor for determining when the amount of stock paper is less than a predetermined amount;

a conveyor extending between the plurality of cushioning conversion machines for conveying a container into which a pad is to be dispensed; and at least one container sensor for providing information to at least one controller from which the controller can determine whether a pad has been dispensed into a container;

whereby the controllers cooperate to selectively switch operation of the cushioning conversion machine from an active state to an inactive state in accordance with information received from the stock supply sensors.

2. The system of claim 1, wherein the controllers cooperate to ensure that a pad is dispensed into substantially all of the containers.

3. The system of claim 1, wherein the container sensor senses the presence of a pad in a container.

4. The system of claim 1, including at one container sensor positioned upstream of a cushioning conversion machine relative to the direction of conveyor travel.

5. The system of claim 1, wherein the pad dispenser includes a plurality of vacuum ports for holding a pad.

6. The system of claim 1, wherein the conveyor includes a plurality of conveyor sections.

7. The system of claim 1, wherein two conveyor sections are oriented relatively orthogonally to one another.

* * * * *

UNITED STATES PATENT AND TRADEMARK OFFICE

CERTIFICATE OF CORRECTION

PATENT NO.: 5,778,631

DATED: July 14, 1998

INVENTOR(S): James A. Simmons

It is certified that error appears in the above-identified patent and that said Letters Patent is hereby corrected as shown below:

On the title page, Item [54] and Column 1, line 2:

In the title, replace the word "DISPENING" with --DISPENSING--.

Signed and Sealed this

Twenty-ninth Day of June, 1999

*Attest:*

*Attesting Officer*

Q. TODD DICKINSON

*Acting Commissioner of Patents and Trademarks*